US005501412A

United States Patent [19]

McAleavey

[11] Patent Number: 5,501,412

[45] Date of Patent: Mar. 26, 1996

[54] APPARATUS AND METHOD FOR CONTROLLING TENSION IN A WEB

[76] Inventor: Michael E. McAleavey, 559 Gettysburg Dr., San Jose, Calif. 95123

[21] Appl. No.: 278,349

[22] Filed: Jul. 21, 1994

[51] Int. Cl.[6] ..... B65H 23/24

[52] U.S. Cl. ..... 242/417.1; 242/418.1; 242/420.6; 226/118

[58] Field of Search ..... 242/417.1, 418.1, 242/420.6, 413.6, 331.4, 331.3, 331.2, 331.1; 226/118, 119

[56] References Cited

U.S. PATENT DOCUMENTS

| | | | |
|---|---|---|---|
| 3,773,275 | 11/1973 | Coppa et al. | 242/331.4 |
| 3,871,597 | 3/1975 | LaMers | 242/420.6 X |
| 3,940,080 | 2/1976 | Bennett | 242/417.1 |

FOREIGN PATENT DOCUMENTS

| | | | |
|---|---|---|---|
| 1554473 | 12/1968 | France | 242/413.6 |
| 192176 | 4/1989 | Japan | 242/413.6 |
| 1110546 | 4/1968 | United Kingdom | 242/413.6 |

*Primary Examiner*—John M. Jillions

[57] ABSTRACT

An apparatus for controlling tension in a web includes devices such as unwinding and calendar or wind-up rollers for supporting opposite ends of the web. A pressure region is formed between the opposite ends of the web adjacent a first side of the web. The pressure region is at a lower pressure than ambient pressure, such that the web is urged in a direction of the pressure region. The web supported at its opposite ends by the supporting devices is placed in tension in an amount corresponding to the pressure of the pressure region.

16 Claims, 1 Drawing Sheet

APPARATUS AND METHOD FOR CONTROLLING TENSION IN A WEB

BACKGROUND OF THE INVENTION

1. Field of the Invention

The present invention relates to apparatus and methods for controlling tension in webs.

2. State of the Art

In recent years, workers in the battery art have begun to understand and recognize the advantages of so-called laminate batteries that include solid polymer electrolytes and sheet-like anodes and cathodes. The advantages of such batteries include lower battery weights than conventional batteries that employ liquid electrolytes, longer service life, and relatively high power densities. The advantages of laminate batteries also include relatively high specific energies, and the elimination of the danger associated with batteries containing spillable liquid electrolytes such as acids.

A laminate battery is disclosed in U.S. Pat. No. 4,925,751. According to that patent, a cathode material is formed from a mixture of an active cathodic material (preferably vanadium oxide $V_3O_8$ or $V_6O_{13}$), a conductive filler material (preferably carbon particles or filaments), and an ionically conductive polymer electrolyte material is laminated on a conductive substrate material such as a nickel or copper web or sheet. A layer of polymer electrolyte material is laminated over the laminated layer of cathode material, and an anode material is applied over the laminated layer of polymer electrolyte material.

The anode material is preferably in the form of a thin sheet or web of lithium foil. Recent efforts to mass produce polymer electrolyte batteries have involved the use of a lithium foil web that is approximately 2 mils thick and approximately 1¾" wide and is, accordingly, quite delicate. The anode web is applied to the electrolyte layer of the electrolyte and cathode laminate by suitable means such as a calendaring device.

The anode web is generally unwound from a roll of anode web material and is then applied to the electrolyte and cathode laminate. The anode, electrolyte, and cathode laminate formed in this manner is generally either rewound onto another roll or cut or otherwise processed to form a desired battery configuration. As the anode material is unwound from an unwinding roller, to maintain a constant speed of the web, it is necessary to increase the rotational speed of the unwinding roller to compensate for the decreasing diameter of the roll of anode material. Similarly, it is also generally necessary to, for example, decrease the rotational speed of any wind-up roller onto which an increasing diameter anode, electrolyte, and cathode laminate is wound.

Changes in speeds of the unwinding and wind-up rollers generally result in changes in tension of the anode web. Accordingly, devices such as tension control rollers have been used to maintain a desired level of tension in the web. Such devices, however, involve direct contact with a surface of the delicate anode web.

When the anode material is applied over the polymer electrolyte and cathode material laminate, it is necessary to avoid tears and similar imperfections in the foil web to provide proper battery performance and avoid failures due to shorting. Further, it is desirable to maintain a substantially constant tension in the anode web during its application to the electrolyte and cathode laminate to avoid wrinkles in or breakage of the anode web. Because of the delicacy of the anode web, conventional tensioning devices have not performed as well as desired and contact between the web and the tensioning devices tends to damage the web, such as by causing tears, wrinkles, and the like, resulting in inconsistent quality.

It is, accordingly, desirable to provide a device adapted to tension a delicate web. It is further desirable to provide a tensioning device that requires minimal direct physical contact with the web.

SUMMARY OF THE INVENTION

The present invention, generally speaking, provides an apparatus and method for controlling tension in a web. In accordance with one aspect of the present invention, an apparatus for controlling tension in a web supported at opposite ends of the web includes means, between the opposite ends of the web, for forming a pressure region adjacent a first side of the web. The pressure region is at a lower pressure than ambient pressure, such that at least a portion of the web is urged in a direction of the pressure region. The web supported at its opposite ends is placed in tension in an amount corresponding to the pressure of the pressure region.

In accordance with another aspect of the present invention, a method for controlling tension in a web supported at opposite ends is disclosed. According to the method, a pressure region is formed adjacent a first side of the web between the opposite ends of the web. The pressure region is at a lower pressure than ambient pressure, such that at least a portion of the web is urged in a direction of the pressure region. The web supported at its opposite ends is placed in tension in an amount corresponding to the pressure of the pressure region.

BRIEF DESCRIPTION OF THE DRAWING

The present invention can be further understood with reference to the following description in conjunction with the appended drawing, wherein like elements are provided with the same reference numerals.

The single drawing, labelled

DETAILED DESCRIPTION OF THE PREFERRED EMBODIMENT

Figure 1:
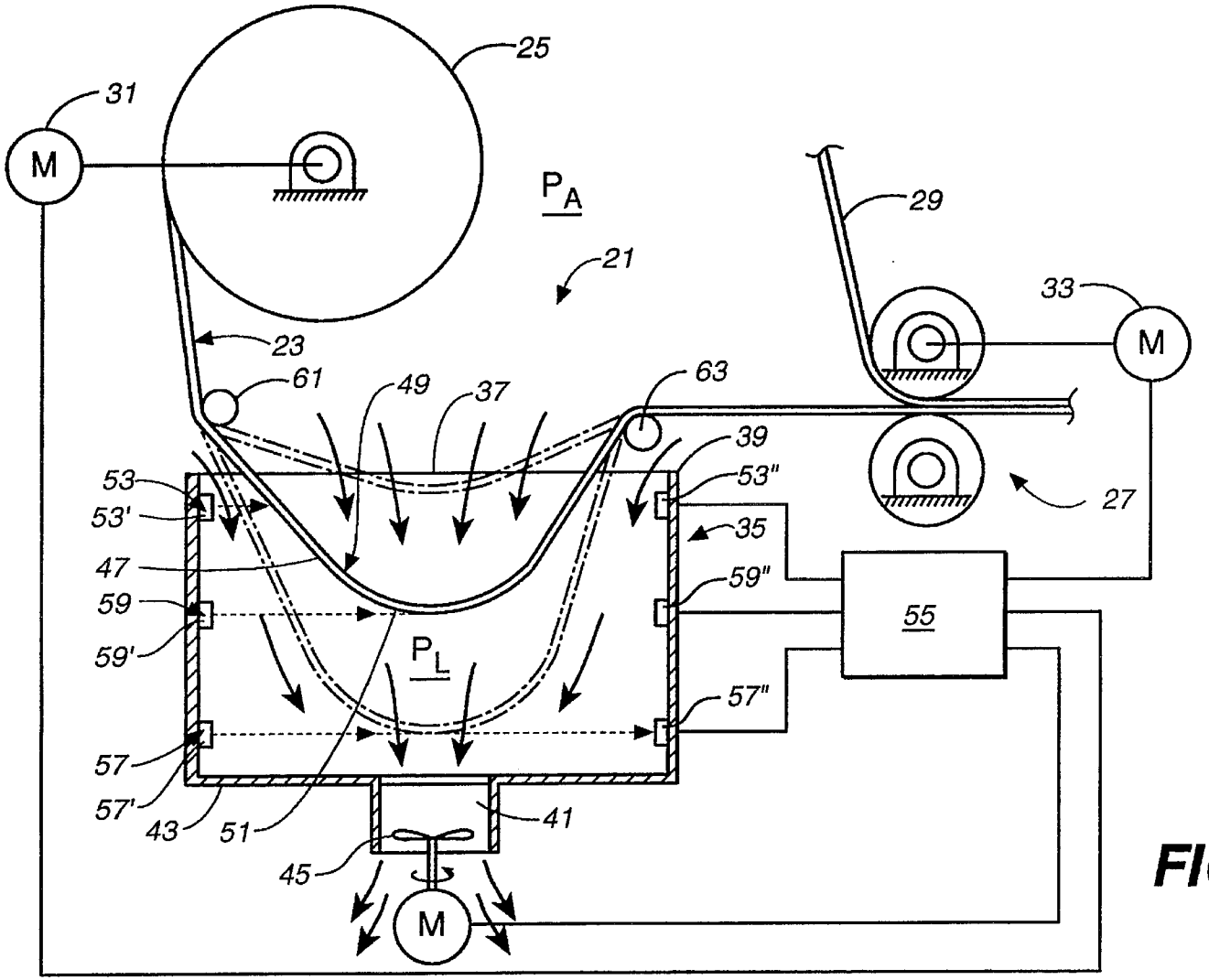
FIG. 1, is a schematic, partially cross-sectional view of a tensioning apparatus according to an embodiment of the present invention.

In FIG. 1, a tensioning apparatus 21 according to an embodiment of the present invention is provided for controlling tension in a web 23. In practice, the web 23 typically is lithium foil, approximately 2 mils thick and 1¾" wide and is used in manufacturing a polymer electrolyte battery such as is disclosed in U.S. Pat. No. 4,925,751, which is hereby incorporated by reference.

The web 23 is preferably supported at opposite ends by an unwinding roller 25 and a drawing roller 27. The term "drawing roller" is used herein to describe any device suitable for supporting, and preferably advancing, the web 23 such as a wind-up roller or calendaring roller or rollers. Ordinarily, the web 23 is applied to a polymer electrolyte and cathode material laminate 29 by being compressed between a pair of calendaring rollers, as seen in the drawing. The calendaring rollers serve the function of supporting an end of the web 23 and advance the web, through frictional contact with the web. It may, for other purposes, be desirable to use a device such as wind-up roller for winding up the web 23 or a laminate including the web.

The web 23 is preferably advanced past the tensioning apparatus at a speed of approximately 300 inches/minute. Driving devices such as motors 31 and 33 preferably separately drive the unwinding roller 25 and the drawing roller 27, respectively. To compensate for changes in the diameter of the rolls of web material on the unwinding roller 25, or on a wind-up roller, which cause changes in the speed of the web 23, the speeds at which the unwinding and drawing rollers are driven by the motors 31 and 33, respectively, are preferably variable.

While the speeds at which the motors 31 and 33 drive the unwinding roller 25 and the drawing roller 27, respectively, may be continuously varied to compensate for continuously decreasing or increasing roll diameters, it is presently preferred to periodically vary the speeds in a step fashion, such as by decreasing or increasing the rotational speeds a predetermined amount after a certain increment of time or in response to other characteristics, such as roll diameter. In either event, the tensioning apparatus 21 is disposed between ends of the web 23 supported on the rollers 25 and 27 and compensates for loosening or tightening of the web as it is unwound and drawn that may occur due to factors such as inconsistencies in tightness of the windings of the rolls on the rollers and the like.

The tensioning control apparatus 21 includes a box 35 having an opening 37 at a first end or side 39. The tensioning apparatus 21 further includes an outlet 41 on a second or opposite end or side 43 of the box 35. A device such as a fan 45 is disposed in or near the outlet 41 and forms a pressure region adjacent a first side 47 of the web 23. The fan 45 evacuates air from an area adjacent the first side 47 of the web 23 and forms a pressure region at a lower pressure $P_L$ than ambient pressure $P_A$ around the box 35. The evacuation of air out of the outlet 41 by the fan 45 urges a portion of the web 23 toward the pressure region at pressure $P_L$. A looped portion 49 of the web 23, which, as noted above, is moved past the tensioning apparatus 21 at a substantially constant speed, is drawn into the box 35 through the opening 37 toward the outlet 41 to compensate for slack in the web due to the unwinding roller 25 unwinding too quickly or the drawing roller 27 drawing too slowly and a substantially constant tension is maintained in the web.

The tensioning apparatus 21 preferably includes sensor devices for detecting a position of a bottom 51 of the looped portion 49 of the web 23 in the box 35. A first sensor 53, which is preferably a light sensor having a light emitting portion 53' and a light detecting portion 53", is preferably provided near the opening 37. In a preferred state of operation, the looped portion 49 of the web 23 blocks a beam of light from the light emitting portion 53' so that the light detecting portion 53" detects no light.

Due to factors such as the unwinding roller 25 unwinding the web 23 too slowly or the drawing roller 27 drawing the web too quickly, the bottom 51 of the looped portion 49 is occasionally drawn upward toward the opening 37 in the box past the beam of light emitted by the light emitting portion 53'. The light detecting portion 53" detects the light and sends a signal to a control apparatus 55, such as a microprocessor. The control apparatus 55 adjusts the speed of one or both of the unwinding roller 25 and the drawing roller 27 so that the bottom 51 of the looped portion 49 is drawn, by the pressure region $P_L$ further into the box 35 and below the beam of light emitted by the light emitting portion 53' so that the light detecting portion 53" stops sending signals to the control apparatus.

A second sensor 57, which is also preferably a light sensor having a light emitting portion 57' and a light detecting portion 57", is preferably provided near the outlet 41. In a preferred state of operation, the looped portion 49 of the web 23 does not block light from the light emitting portion 57' so that the light detecting portion 57" detects light.

Due to factors such as the unwinding roller 25 unwinding the web 23 too quickly or the drawing roller 27 drawing the web too slowly, the bottom 51 of the looped portion 49 is occasionally drawn, by the pressure region $P_L$, downward toward the outlet 41 in the box 35 past the beam of light emitted by the light emitting portion 57'. The light detecting portion 57" detects the absence of light and sends a signal to the control apparatus 55. The control apparatus 55 adjusts the speed of one or both of the unwinding roller 25 and the drawing roller 27 so that the bottom 51 of the looped portion 49 is drawn upward in the box away from the outlet 41, in the direction opposite the direction in which the web 23 is urged to move by the pressure region $P_L$, and above the beam of light emitted by the light emitting portion 57'. The light detecting portion 57" then stops sending signals to the control apparatus 55.

A third sensor 59, which is also preferably a light sensor having a light emitting portion 59' and a light detecting portion 59" is provided approximately mid-way between the first sensor 53 and the second sensor 57. The third sensor 59 detects when the bottom 51 of the looped portion 49 is within an optimal range of positions in the box 35.

When the control apparatus 55 adjusts the speed of one or both of the unwinding or drawing rollers 25 and 27 in response to a signal from the first sensor 53, the unwinding roller is sped up or the drawing roller is slowed down until the bottom 51 of the looped portion 49 of the web 23 blocks the light emitted by the light emitting portion 59' of the third sensor 59. When, after the control apparatus 55 has previously received a signal from the first sensor 53, the light detecting portion 59" detects no light, a signal is sent to the control apparatus to maintain the speed of the unwinding roller 25 and the drawing roller 27. The speed of the unwinding roller 25 and the drawing roller 27 are then preferably maintained at that rate of speed until another signal is received from one of the first or second sensors 53 or 57.

Similarly, when the control apparatus 55 adjusts the speed of one or both of the unwinding or drawing rollers 25 and 27 in response to a signal from the second sensor 57, the unwinding roller is slowed down or the drawing roller is sped up until the bottom 51 of the looped portion 49 of the web 23 permits light emitted by the light emitting portion 59' of the third sensor 59 to be detected by the detecting portion 59". When, after the control apparatus 55 has previously received a signal from the second sensor 57, the light detecting portion 59" detects light, a signal is sent to the control apparatus to maintain the speed of the unwinding roller 25 and the drawing roller 27. The speed of the unwinding roller 25 and the drawing roller 27 are then preferably maintained at that rate of speed until another signal is received from one of the first or second sensors 53 or 57.

It is ordinarily preferred to maintain the drawing roller 27 or other take-up device at a constant speed and adjustments to roller speeds are made only to the unwinding roller 25. If desired, the third sensor 59 may be omitted and the bottom 51 of the looped portion 49 of the web 23 may be drawn back and forth between the boundary positions defined by the first and second sensors 53 and 57. It is understood, of course, that the foregoing has only described one of many possible control techniques for maintaining tension in the web 23. For example, it may, in certain circumstances, be desirable to adjust the speed of the fan 45 in response to the position of the bottom 51 of the looped portion 49 of the web 23 in the box 35, thereby adjusting the pressure region $P_L$ so that tension in the web is increased or decreased as a function of the position of the bottom 51 of the looped portion 49.

To facilitate formation of the looped portion 49, and to permit redirecting the web 23 prior to and after the tensioning apparatus 21, it is preferred to provide a first and a second redirecting roller or pin 61 and 63, respectively, at points near the opening 37. The web 23 unwound from the unwinding roller 25 and drawn by the drawing roller 27 extends around a portion of the first and second redirecting rollers or pins 61 and 63 so that the web is not urged against the edges of the box 35. The first and second redirecting pins or rollers 61 and 63 preferably have a very low coefficient of friction in contact with the web 23 so that the web slides or passes over the roller with no deleterious effects.

In a method of controlling tension in the web 23, the pressure region $P_L$ is formed adjacent the first side 47 of the web between the opposite ends of the web. The pressure region is at a lower pressure $P_L$ than ambient pressure $P_A$ such that at least a portion 49 of the web 23 is urged in a direction of the pressure region and, more particularly, toward the outlet of the box 35. The web 23, supported at its opposite ends by the unwinding roller 25 and the drawing roller 27, is placed in tension in an amount corresponding to the pressure $P_L$ of the pressure region. The pressure $P_L$ of the pressure region is adjusted, if desired, by adjusting the speed of the fan 45 or other device for creating a vacuum.

The first, second, and third sensors 53, 57, and 59, respectively, detect positions of the looped portion 49 of the web 23 adjacent the pressure region and, more particularly, detect when the bottom 51 of the looped portion passes beams of light emitted by light emitting portions 53', 57', and 59' of the sensors. As the web 23 is unwound from the unwinding roller 25 and drawn by the drawing roller 27, the speed of at least one of the unwinding roller and the drawing roller is adjusted in response to signals from the sensors 53, 57, and 59. The first sensor 53 detects when the bottom 51 of the looped portion 49 of the web 23 reaches a first boundary position of the portion of the web defined by a beam of light emitted from the light emitting portion 53' and detected by the light detecting portion 53". The second sensor 57 detects when the bottom 51 of the looped portion 49 of the web 23 reaches a second boundary position of the portion for the web intercepting a beam of light emitted from the light emitting portion 57' and detected by the light detecting portion 57". The first and second sensors 53 and 57 send signals to the control apparatus 55 to control the speed of the unwinding and drawing rollers 25 and 27, preferably just the unwinding roller, such that the bottom 51 of the looped portion 49 of the web 23 is limited to movement between the first and second boundary positions.

The third sensor 59 detects when the bottom 51 of the looped portion 49 of the web 23 is within an optimal range of positions, permitting for some leeway up or down, between the first and second sensors 53 and 57. The third sensor 59 sends a signal to the control apparatus 55 to control the speed of the unwinding and drawing rollers, preferably just the unwinding roller, such that the bottom 51 of the looped portion 49 of the web 23 is maintained within the optimal range of positions.

The box 35 is preferably approximately twelve inches deep. The distance between the first and third sensors 53 and 59 is preferably approximately 1.5 inches. Similarly, the distance between the third and second sensors is preferably approximately 1.5 inches. The distance between the bottom 51 of the looped portion 49 of the web 23 when it first blocks the light emitted by the light emitting portion 57' of the second sensor 57 is preferably approximately two inches.

The foregoing has described the principles, preferred embodiments and modes of operation of the present invention. However, the invention should not be construed as limited to the particular embodiments discussed. Instead, the above-described embodiments should be regarded as illustrative rater than restrictive, and it should be appreciated that variations may be made in those embodiments by workers skilled in the art without departing from the scope of the present invention as defined by the following claims.

What is claimed is:

1. An apparatus for controlling tension in a web supported at opposite ends of the web, the apparatus comprising;

means, between the opposite ends of the web, for forming a pressure region adjacent a first side of the web, the pressure region being at a lower pressure than ambient pressure, such that at least a portion of the web is urged in a direction of the pressure region;

the web supported at its opposite ends being placed in tension in an amount corresponding to the pressure of the pressure region;

means for adjusting a pressure of the pressure region;

sensor means for determining a position of the portion of the web and for generating a signal corresponding to the position of the portion of the web; and a control apparatus, the control apparatus receiving the signal from the sensor means and generating a signal, received by the pressure adjusting means, in response to the signal from the sensor means, the pressure adjusting means adjusting the pressure of the pressure region in response to the signal from the control apparatus.

2. The apparatus as set forth in claim 1, wherein the web is moved through the pressure region forming means by an unwinding roller and a drawing roller for unwinding and drawing up the web, respectively.

3. The apparatus as set forth in claim 2, wherein a speed of at least one of the unwinding roller and the drawing roller is controlled by the control apparatus in response to the signal from the sensor means.

4. The apparatus as set forth in claim 1, wherein the sensor means includes a first sensor for detecting a first boundary position of the portion of the web and a second sensor for detecting a second boundary position of the portion of the web, the first and second sensors sending signals to the control apparatus for controlling a speed of means for moving the web through the pressure region forming means such that the portion of the web is limited to movement substantially between the first and second boundary positions within the pressure region forming means.

5. The apparatus as set forth in claim 4, wherein the sensor means further includes a third sensor for detecting when the portion of the web is within an optimal range of positions, the third sensor sending signals to the control apparatus to control the speed of the moving means such that the portion of the web is maintained within the optimal range of positions.

6. The apparatus as set forth in claim 1, further comprising means for defining a loop portion of the web adjacent the pressure region forming means.

7. The apparatus as set forth in claim 6, wherein the pressure region forming means includes a box having an open first end through which the loop portion of the web is adapted to extend and a second end through which air is drawn to form the pressure region adjacent the first side of the web.

8. The apparatus as set forth in claim 1, wherein the pressure region forming means includes a fan for drawing air away from, and thereby forming the pressure region in, an area adjacent the first side of the web.

9. A method for controlling tension in a web supported at opposite ends, the method comprising the steps of:

forming a pressure region adjacent a first side of the web between the opposite ends of the web, the pressure region being at a lower pressure than ambient pressure, such that at least a portion of the web is urged in a direction of the pressure region, the web supported at its opposite ends being placed in tension in an amount corresponding to the pressure of the pressure region;

detecting, with a sensor means, a position of the portion of the web adjacent the pressure region and generating a signal corresponding to the position of the portion of the web;

adjusting a pressure of the pressure region in response to the signal corresponding to the position of the portion of the web.

10. The method as set forth in claim 9, comprising the further steps of unwinding the web from an unwinding roller and drawing up the web with a drawing roller, the unwinding roller and the drawing roller supporting the opposite ends of the web.

11. The method as set forth in claim 10, comprising the further step of controlling a speed of at least one of the unwinding roller and the drawing roller in response to the signal from the sensor means.

12. The method as set forth in claim 9, wherein the sensor means detects when the portion of the web reaches a first boundary position of the portion of the web and a second boundary position of the portion of the web, the sensor means sending the signal to control means to control a speed of means for moving the web through the pressure region forming means such that the portion of the web is limited to movement between the first and second boundary positions.

13. The method as set forth in claim 12, wherein, when the sensor means detects when the portion of the web is within an optimal range of positions, the sensor means sends signals to the control means to control the speed of the moving means such that the portion of the web is maintained within the optical range of positions.

14. The method as set forth in claim 9, comprising the further step of forming a loop portion of the web adjacent the pressure region.

15. The method as set forth in claim 14, wherein the loop portion of the web extends through an opening in a box and air is drawn through a second end of the box to form the pressure region adjacent the first side of the web.

16. The method as set forth in claim 9, wherein the pressure region is formed by a fan that draws air away, and thereby forms the pressure region, adjacent the first side of the web.

* * * * *